US005949338A

United States Patent [19]

Masi et al.

[11] Patent Number: 5,949,338

[45] **Date of Patent: *Sep. 7, 1999**

[54] PERSONAL PROTECTION DEVICE

[76] Inventors: J. Roger Masi, 55 State St., Hackensack, N.J. 07601; William F. Hall, 93 Gordonhurst Ave., Montclair, N.J. 07043

[ * ] Notice: This patent is subject to a terminal disclaimer.

[21] Appl. No.: 08/886,563

[22] Filed: Jul. 1, 1997

Related U.S. Application Data

[63] Continuation-in-part of application No. 08/280,392, Jul. 26, 1994, Pat. No. 5,517,180, and application No. 08/645,810, May 14, 1996, Pat. No. 5,644,297.

[51] Int. Cl.[6] ..... G08B 23/00

[52] U.S. Cl. ..... 340/573.1; 340/574; 340/693.5; 340/321; 222/613; 116/2; 116/DIG. 44

[58] Field of Search ..... 340/573, 574, 340/693, 321; 200/61.93, 519; 222/39, 613, 135, 78, 94, 153.1, 175; 116/2, DIG. 44; 482/129; 604/212

[56] References Cited

U.S. PATENT DOCUMENTS

| | | | |
|---|---|---|---|
| 3,794,791 | 2/1974 | Thomson | 200/61.93 |
| 4,241,850 | 12/1980 | Spear | 222/39 |
| 4,449,474 | 5/1984 | Mariol | 116/2 |
| 4,581,021 | 4/1986 | Landau et al. | 604/212 |
| 4,716,402 | 12/1987 | Francis | 340/693 |
| 5,011,044 | 4/1991 | Brown | 222/78 |
| 5,137,178 | 8/1992 | Stokes et al. | 222/94 |
| 5,289,164 | 2/1994 | Novak | 340/574 |
| 5,339,990 | 8/1994 | Wilder | 222/135 |
| 5,458,263 | 10/1995 | Ciammitti et al. | 222/153.1 |
| 5,517,180 | 5/1996 | Masi et al. | 340/573 |
| 5,556,003 | 9/1996 | Johnson et al. | 222/39 |
| 5,629,679 | 5/1997 | Cranford et al. | 340/574 |
| 5,644,297 | 7/1997 | Masi et al. | 340/573 |
| 5,709,635 | 1/1998 | Denison | 482/129 |

*Primary Examiner*—Benjamin C. Lee
*Attorney, Agent, or Firm*—Sheldon H. Parker

[57] ABSTRACT

A cylindrical personal protection device is disclosed having an aerosol cylinder with a nozzle, a light and a removable safety cap. In an embodiment with dual cylinders, the cylinders contain a deterrent spray and a glowing liquid. A trigger proximate the cylinders expells the contents of the cylinders where they are mixed prior to explusion. A body section has a battery receiving area and an alarm. The electronics connect the battery receiving area, trigger, alarm and light. The electronics activates the light and alarm, in response to activation of the trigger, causing them to pulse simultaneously. The cylinders and the body portion are removably connected to one another. A safety lid prevents activation of the trigger.

21 Claims, 5 Drawing Sheets

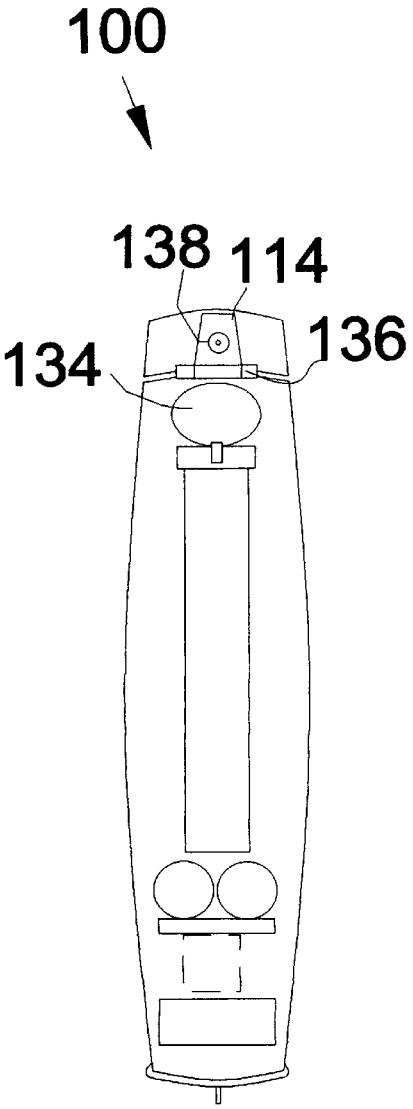
Figure 5
Figure 6
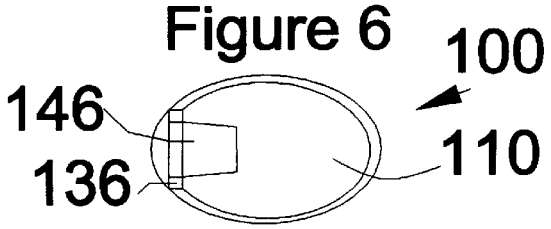
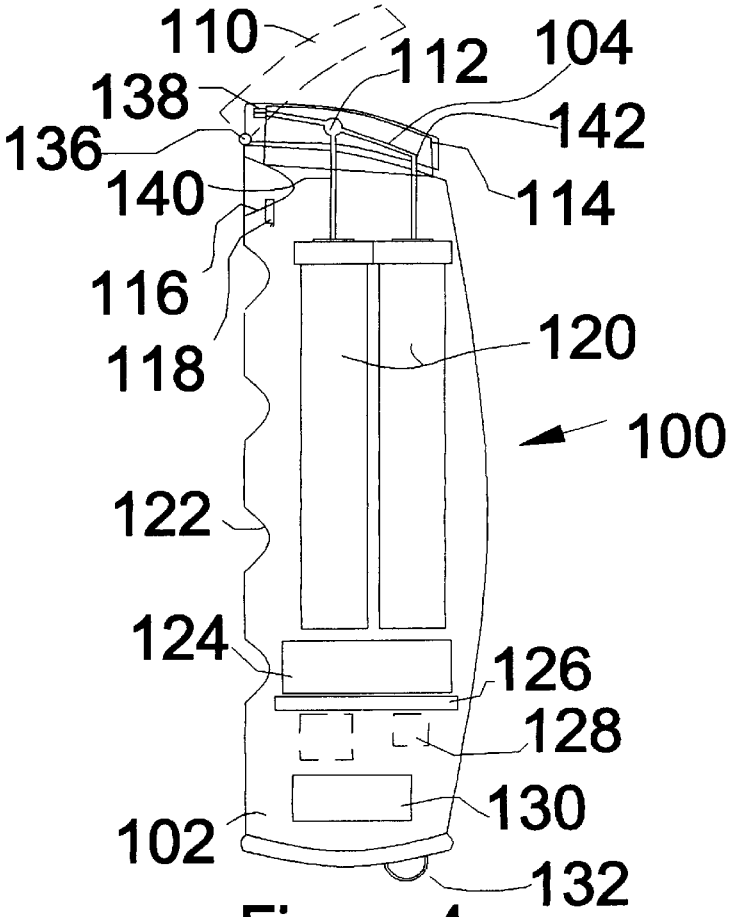
Figure 4

PERSONAL PROTECTION DEVICE

This is a continuation-in-part of applications Ser. No. 08/280,392 filed on Jul. 26, 1994, now U.S. Pat. No. 5,517,180 and Ser. No. 08/645810 filed on May 14, 1996, now U.S. Pat. No. 5,644,297.

BACKGROUND OF THE INVENTION

1. Field of the Invention

The instant disclosure relates to a convenient, hand held personal protection device which provides additional protection through multi-layering its defenses and alarms.

2. Brief Description of the Prior Art

With the increasing prevalence of violent crime is an acute need for a personal protection device that is safe, easy to use, and compact Sales of typical defensive sprays, such as Mace, have increased dramatically in the last several years. The media coverage of violent crimes, particularly rapes and muggings against women, have heightened the fear that women, as well as men, feel in conducting their personal or business affairs in urban or suburban areas. Not only have the media extensively covered the wave of violent crime in this country, but the increases in violent crime have been documented statistically. In New Jersey, for example, violent crime rose 67% since 1974. Among juveniles, violent crimes increased 69% in that twenty year period and arrests of juveniles for weapons offenses rose 60% last year alone. A personal protection device, therefore, will serve the dual purpose of both protecting the potential victims and easing anxiety with the knowledge that an attacker can be effectively deterred by the device.

Various personal protection devices have been devised to deter attackers. In U.S. Pat. No. 5,032,824 to Corbin, a hand held alarm is disclosed which sounds a high intensity light and loud horn. The Corbin device, however provides no physical deterrent to the attacker. In a remote area, an attacker may gamble that no one will hear the alarm or, alternatively, he can finish the attack prior to anyone's arrival.

U.S. Pat. No. 4,967,684 to Vidovic et al discloses a loud audio alarm system for a ski-pole to locate lost skiers. Again, there is no physical deterrent to the attacker.

U.S. Pat. No. 5,086,377 to Roberts discloses a defense baton which incorporates audible and visible alarms with a defense spray. Carrying the baton, however, would be awkward and would be obvious to a potential attacker. The obviousness may dissuade some potential attackers, however many may simply alter their attack to render the baton ineffective.

Novak, in U.S. Pat. No. 5,289,164 discloses a glove which incorporates a signal and spray retardant. The device, although providing a physical deterrent, is not readily put on and removed.

U.S. Pat. No. 4,449,474 to Mariol discloses a personal security device which utilizes a two piece telescoping housing. The device incorporates a manual whistle, flash cube and pressurized gas. The odorous pressurized gas may also include a paint or stain. When the pressurized gas is expelled it emits a shrieking noise. The Mariol patent provides the advantage over many prior art patents in that it incorporates a deterrent to the attacker. However, the skrieking noise appears to be a continuous sound, which may be mistaken for other sounds. The flash cube provides only one opportunity to visually blind the attacker. The Mariol patent does not allow for any misses. The sound is only emitted during the spraying of the gas and the light is only a rapid flash.

In U.S. Pat. No. 4,846,044 an electric stun gun using electrically conductive fluid is disclosed. The stun gun disclose although effective, is not portable to the extent that it will fit into a pocket or purse. A more portable stun gun is disclosed in U.S. Pat. No. 4,843,336 to Kuo. The stun gun also incorporates a siren and strobe light. The stun gun, however requires a proximity to the assailant which may not be desirable.

The prior art does not provide a small, convenient, multi-layered personal protection device. The instant invention discloses a device that combines multiple layers of defense against potential attackers, together with small size, safety and convenience of use.

SUMMARY OF THE INVENTION

A cylindrical personal protection device is disclosed which has an ampule section with a first end and a second end, and containing a flexible ampule with a nozzle which extends through the first end of the ampule section. At least a portion of the first end of the ampule portion is removable, thereby allowing access to the ampule. At least one trigger is proximate the ampule and extends beyond the periphery of the ampule section. The ampule section further comprises a light proximate its second end. A safety cap, which can be friction fit over the protective bumpers, covers the first end of the ampule section. Alternatively, the safety cap can be spring hinged to a portion of the protective bumpers. When the spring hinged safety cap is used, the safety pin extends beyond the safety cap, thereby preventing the safety cap from opening. A body section has a first end and a second end with a battery receiving area and an alarm which is proximate the second end. The electronics connect the battery receiving area, trigger, 110 DB piezo alarm and light. The electronics activates the light and alarm, in response to activation of the trigger, causing them to pulse simultaneously. The light and alarm can be activated immediately or delayed by a predetermined time period. The ampule portion and the body portion are removably connected to one another. At least a pair of protective bumpers, having a periphery greater than the periphery of the personal protection device, are provided to prevent damage. A safety pin extending from the second end of the body section to proximate the first end of the ampule section runs in a groove dimensioned to receive the safety pin. The safety pin prevents the trigger from contacting the ampule. Partial removal of the safety pin, through use of a gripping portion, allows the trigger to contact the ampule, expelling the contents of the ampule, and activating the alarm and light.

The ampule comprises multiple interior dividers which divide the ampule into multiple chambers. The multiple interior dividers break upon contact by the trigger, thereby allowing the contents of the chambers to mix. One of the multiple chambers contains an irritative substance, such as pepper fluid. Additionally, at least one of the multiple chambers contains a marking substance such as a glowing fluid. The first portion of glowing fluid is maintained in the second of the multiple chambers and the second portion of the glowing fluid is maintained in the third of the multiple chambers and breaking the dividers allows the first and second portion of the glowing fluid to mix prior to expulsion from the nozzle. The light, once activated, repeatedly flashes on an off and the activated alarm is intermittent.

In an alternate embodiment, a section of the body portion proximate the battery receiving area is removable, thereby allowing access to the battery receiving area. Additionally, a second trigger and a second safety pin, approximately opposite one another, can be used. An alternate ampule comprises multiple interior dividers dividing the ampule into multiple chambers, at least one of the multiple interior dividers being a pliable member, thereby preventing the contents of at least two of the chambers from mixing. Dual nozzles can be positioned to expel the contents of the two chambers

BRIEF DESCRIPTION OF THE DRAWINGS

The advantages of the instant disclosure will become more apparent when read with the specification and the drawings, wherein:

FIG. 4 is a cutaway side view of the safety lid protection device with dual canisters;

FIG. 5 is a cutaway front view of the safety lid protection device with dual canisters;

FIG. 6 is a top view of the safety lid of FIG. 4;

DETAILED DESCRIPTION OF THE INVENTION

Figure 1:
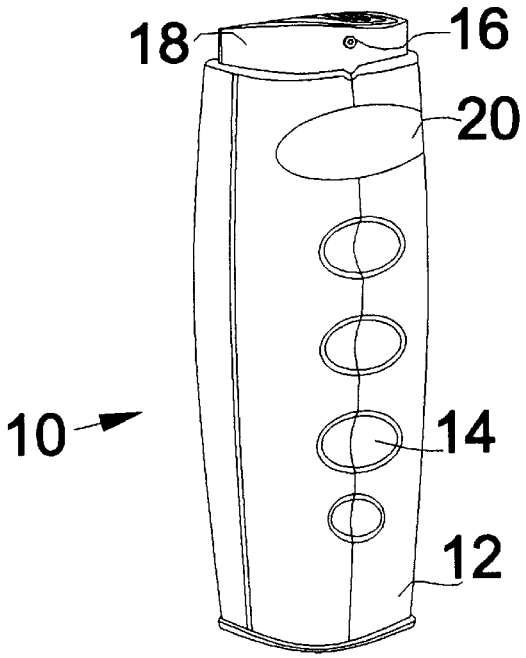
FIG. 1 is a perspective view of the front of the protection device.
Figure 2:
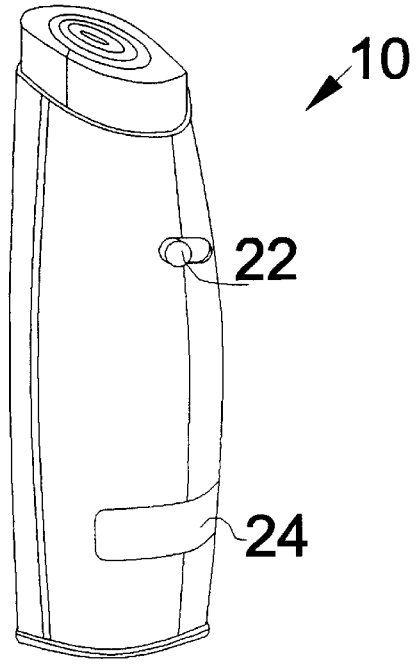
FIG. 2 is a perspective back view of the protective device of FIG. 1.
Figure 3:
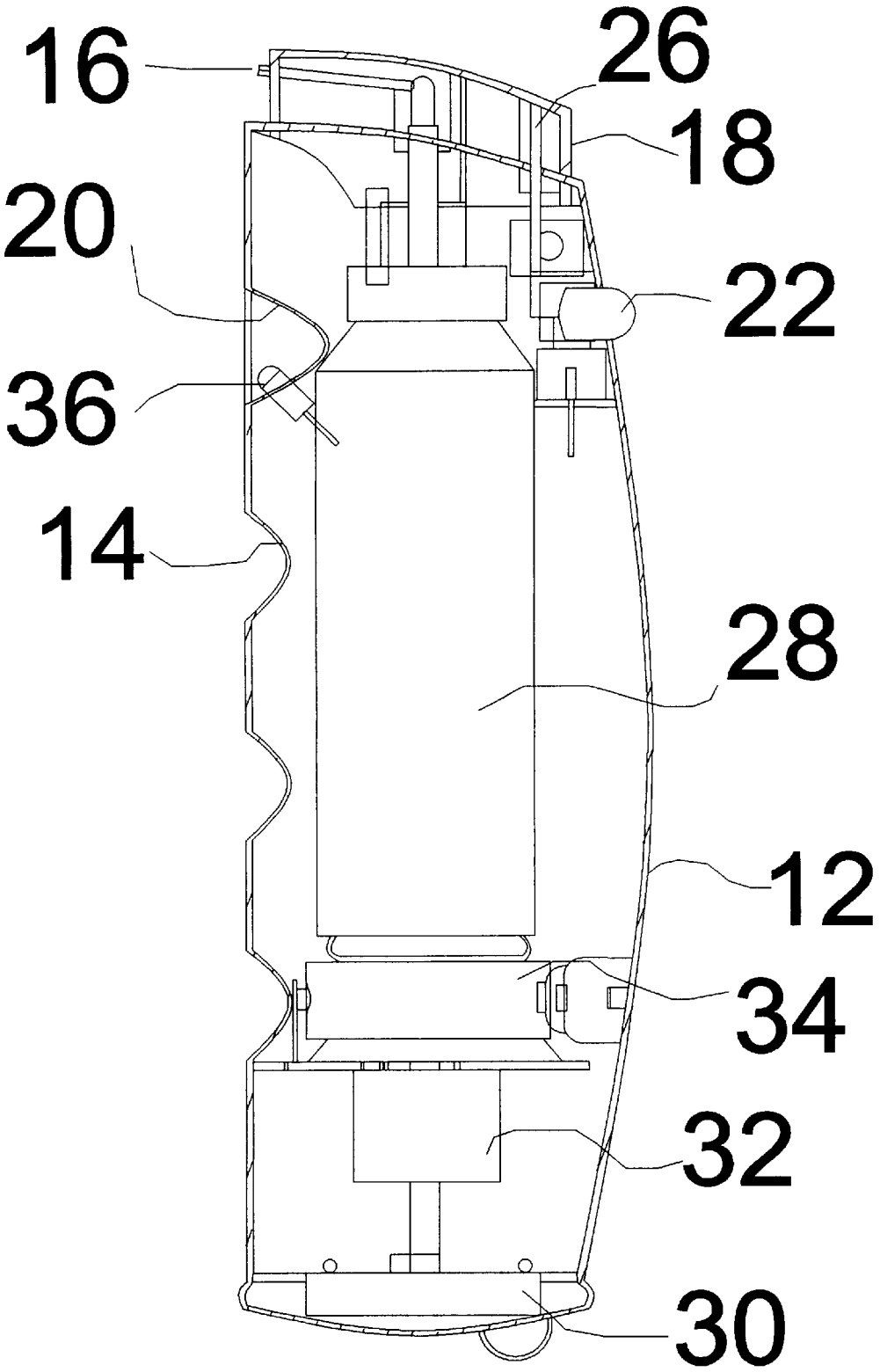
FIG. 3 is a cutaway side view of the protective device of FIG. 1.

The design of the instant personal protection device provides a number of advantages over the prior art. The device is a non-lethal defensive weapon that is easily used and provides a high degree of protection against a potential attacker. The device is capable of being stored and carried for long periods of time without losing it effectiveness. Since the device is not a lethal device, its accidental triggering or its usage by unauthorized individuals or children would not cause permanent damage. In fact, since the device, in the preferred embodiment, contains only one pepper spray and glowing fluid emission, as opposed to multiple emissions in the standard Mace devices, the device is thereby rendered safer in the hands of unauthorized individuals. The instant device is inexpensive to manufacture, thereby making it readily available to the majority of consumers As illustrated in FIGS. 1–3, the protection device 10 is ergonomically designed to fit a user's hand. The body 12 of the device 10 is preferably cylindrical with finger grips 14 along the exterior front. A reflective light 20 is provided as part of the alarm system. Preferably the reflective light flashes, although a solid light can be used. The light bulb 36 must have a high visibility and is preferably overdriven to produce a flashing, high intensity strobe-light effect. Due to the high intensity of the bulb 36, replacements will be required periodically, and easy accessibility to the bulb 36 should be provided. The spray head 18 activates the interior canister, emitting the spray through the nozzle 160. The safety switch 22 prevents the inadvertent depression of the spray head 18. The release of the safety switch 22 also activates the electronics involved with the device 10. When in the locked, or non-activated position, the safety bar 26 prevents the depression of the spray head 18. When the switch 22 is in the activate, or open, position the user is free to depress the spray head 18, activating the aerosol canister 28. The depression of the spray head 18 also serves to activate the electronics contained within the body 12. The device 10, in addition to the aforenoted canister 28 of irritant spray and light 20, contains a high decibel piezo module 30 and a circuit board 32. The power, received from the batteries 34, is directed to the circuit board 32, which in turn is connected to the light bulb 36 and piezo module 30. In one embodiment, the light 20 and/or piezo module 30 are on a delay which allows for the irritant spray to be sprayed prior to the assailant closing his/her eyes in response to the light.

The protection device 100 illustrated in FIGS. 4 through 6 is provided with dual canister 120 and a protective spring loaded safety cap 110. Although the loudspeaker 130, printed circuit board 126, key chain loop 132, electronics 128 and batteries 124 are arranged somewhat differently than in FIGS. 1–3 of the parent patents U.S. Pat. Nos. 5,644,297 and 5,517,180, which are incorporated herein in full, the functions are the same. The dual aerosol canisters 120 are provided with nozzles 140 and 142 which extend through the top of the body 102 into the trigger button 114. One of the dual canisters 120 contains the first part of a glowing fluid while the other canister contains the second part of the glowing fluid and an irritant combination. Since the current, affordable glowing fluids require mixing just prior to ejection, two canisters and a mixing area 112 are required. The transfer tube 104 connects the nozzle 142 with the mixing area 112. As the contents of the canisters 120 are expelled, they are mixed in the mixing area and expelled through the exterior nozzle 138. A strobe light 118 is provided and is preferably set within a reflective surface 116 to maximize the brightness of the light 118. A bulb lens 134 disperses the bright light over a wider range. The safety cap 110 is provided with a spray head opening 146 to allow the safety cap 110 to close.

Figure 8:
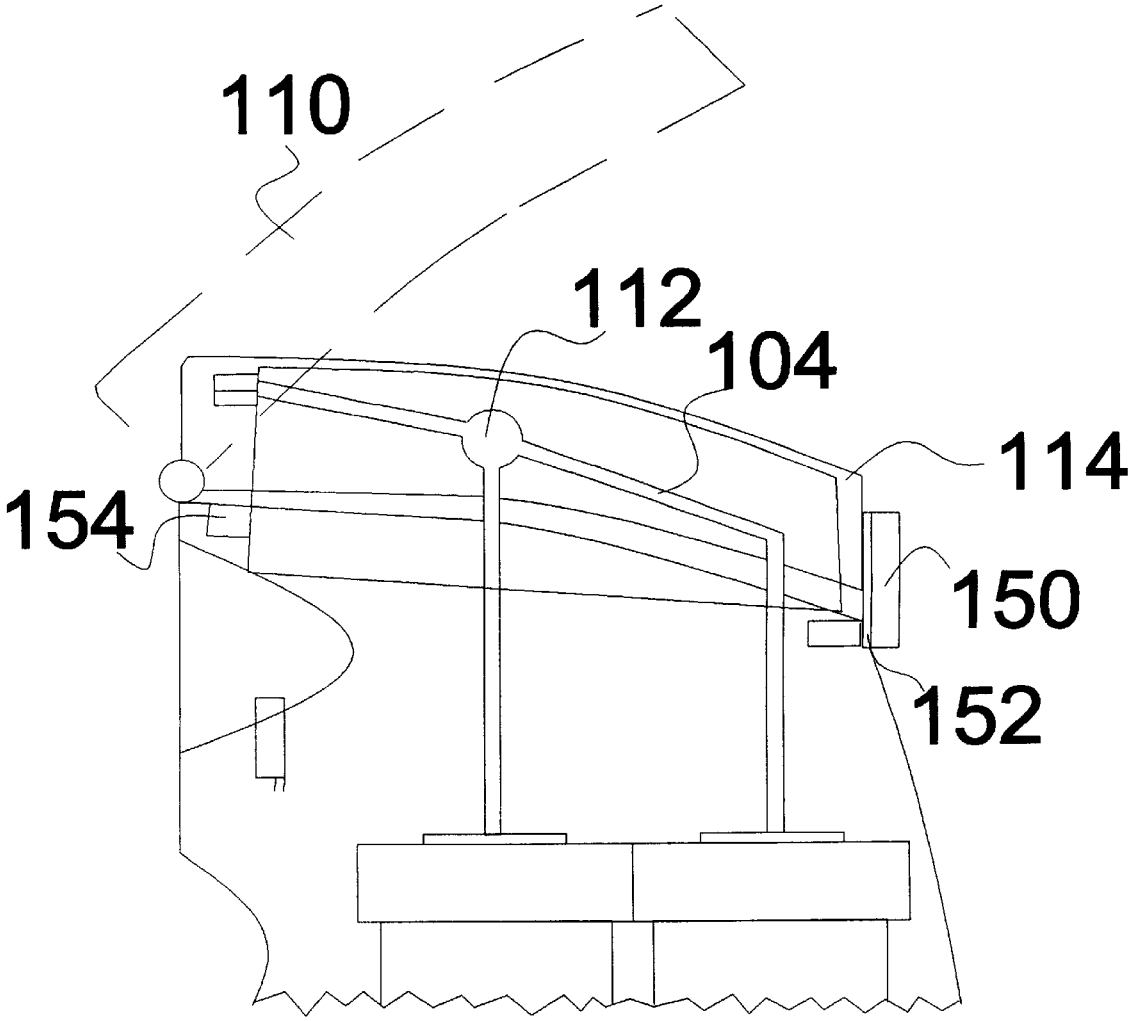
FIG. 8 is an cutaway side view of the safety lid.

The safety cap 110 is maintained in the unarmed, closed position through use of a detent 150 located conveniently on the device 100. The hinge 136 is spring loaded and, once the detent 150 (FIG. 8) is released moves the safety cap 110 into the open position. As the safety cap 110 moves, the movement activates the arming switch 154, thereby allowing activation of the device 100 through pressure on the trigger button 114. Once the trigger button 114 is pressed down, the electronics switch 152 is activated, setting off the alarm and strobe light 118. The user can release the trigger button 114, stopping the spraying action, and then repress the button 114 at any time. The electronics continue to be activated independently until the electronics switch 152 is deactivated. To deactivate the electronics switch 152, the safety cap 110 is snapped back into the closed position, closing the arming switch 154. This deactivates all circuits as well as preventing inadvertent expulsion of the irritants. In the preferred embodiment, the body 102 can be opened and the expendable elements, such as canisters 120, batteries 124 and light bulbs 118 can be replaced. Alternatively, the unit can be disposable.

The placement of the detent and switches in FIGS. 4–6 and 8 is for illustration purposes only and placement and type of switch can be changed and will be known to those skilled in the art.

Although the dual canisters containing the elements required to mix the glowing fluid, are described herein with reference to a personal protection device, any elements can be mixed with the glowing fluids. As stated heretofore, and in the parent applications, the fluids must be stored separately and mixed upon expulsion. This design can be used in police weapons, such as tear gas, as well as personal defense devices.

Figure 7:
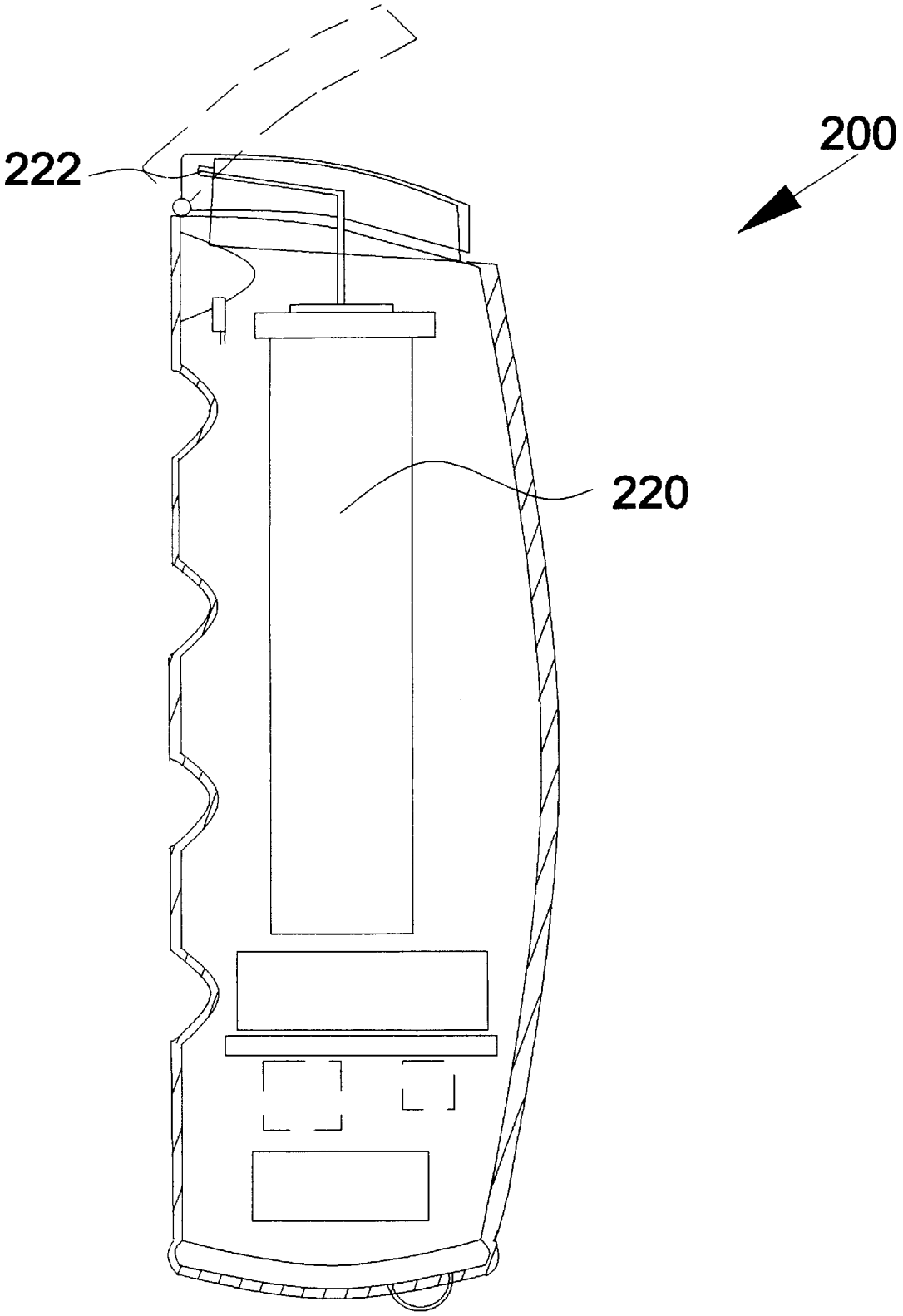
FIG. 7 is a cutaway side view of the safety lid protection device with a single canisters.

FIG. 7 illustrates the single canister 220 protection device 200. In this design contains both the light and piezo alarms, however only a single irritant is expelled. Because of the use of a single canister 220, a single exterior nozzle 22 is used. The activation of the electronics remains as described heretofore.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A personal protection device, said personal protection device comprising:

a body section, said body section having a first end and a second end;

at least one canister receiving area within said body section, each of said at least one canister receiving area having a first end and a second end, at least one aerosol canister, each of said at least one canister having a nozzle extending through said first end of said at least one canister receiving area and being proximate said first end of said body section and providing for expulsion of said at least one canister contents into a transfer tube, said transfer tube directing the path of said contents, canister activation member, said canister activation member being in contact with each of said at least one canister, safety member, said safety member preventing said canister activation member from coming in contact with each of said at least one canister, a trigger button, said trigger button being at said first end of said body section and being in interactive contact with said safety member and said canister activation member, a light, said light being proximate said nozzle, a battery receiving area within said body section, audio alarm means, said audio alarm means being proximate said second end, electronic means, said electronic means being connected to said battery receiving area, said safety member, said alarm means and said light, wherein said safety member prevents said trigger button from contacting said canister activation means and deactivation of said safety member permits said trigger button to be depressed thereby contacting said canister activation member, expelling said contents and activating said audio alarm means and said light.

2. The personal protection device of claim 1 further comprising gripping means between said first end and said second of said body, said gripping means being designed to receive and position a user's fingers.

3. The personal protection device of claim 1 wherein activation of said light is delayed from the contact of said canister activation member with said canister button.

4. The personal protection device of claim 1 wherein activation of said audio alarm means is delayed from the contact of said canister activation member with said canister button.

5. The personal protection device of claim 1 wherein said light, once activated, repeatedly flashes on an off.

6. The personal protection device of claim 1 wherein said audio alarm means is intermittently activated.

7. The personal protection device of claim 1 further comprising a hinged safety cap, said safety cap being maintained in a closed position by a locking member wherein release of said safety cap permits the user to depress said trigger button, expelling said canister contents and activating said audio alarm means and said light means.

8. The personal protection device of claim 7 further comprising spring means, said spring means opening said safety cap upon release of said locking member.

9. The personal protection device of claim 1 wherein a first of said at least one canister contains an irritative substance.

10. The personal protection device of claim 9 wherein said first of said at least one canister further contains a marking substance.

11. The personal protection device of claim 9 further comprising a second aerosol canister containing a marking substance and having a second transfer tube.

12. The personal protection device of claim 11 further comprising an aerosol mixing area, said aerosol mixing area being proximate a first nozzle and in fluid contact with said transfer tube and said second transfer tube.

13. The personal protection device of claim 12 wherein said marking substance is a glowing fluids one portion of said glowing fluid being maintained in said second canister and a second portion of said glowing fluid mixed with said irritative substance in said first canister, said first portion and said second portion of said glowing fluid mixing in said aerosol mixing area during expulsion from said canisters.

14. A personal protection device, said personal protection device comprising:

a body section, said body section having a first end and a second end and gripping means, between said first end and said second end, said gripping means being designed to receive a user's fingers;

at least one canister receiving area within said body section, each of said at least one canister receiving area having a first end and a second end, at least one aerosol canister, each of said at least one canister having a nozzle extending through said first end of said canister section and being proximate said first end of said body section and providing for expulsion of each of said at least one canister's contents into a transfer tube, said transfer tube directing the path of said contents, at least one of said at least one canister containing an irritative substance, canister activation member, said canister activation member being in contact with each of said at least one canister, a battery receiving area within said body section, safety member, said safety member preventing said canister activation member from coming in contact with each of said at least one canister, a trigger button, said trigger button being at said first end of said body section and being in contact with said safety member and proximate said canister activation member, a light, said light being proximate said nozzle and, once activated, flashes intermittently, audio alarm means, said audio alarm means being proximate said second end and, once activated, sounds intermittently, electronic means, said electronic means being connected to said battery receiving area, said safety member, said audio alarm means and said light, wherein said safety member prevents said trigger button from contacting said canister activation means and deactivation of said safety member permits said trigger button to contact said canister activation member thereby permitting the user to depress said trigger button, expelling said canister contents and activating said light and said audio alarm means.

15. The personal protection device of claim 14 wherein activation of said light and said audio alarm means are time delayed, from the time of said canister activation member contacting said canister.

16. The personal protection device of claim 14 further comprising a second canister, said second canister containing a glowing fluid marking substance, a first portion of said glowing fluid marking substance being maintained in said second canister and the second portion of said glowing fluid being mixed with said irritative substance in a first of said at least one canister, said first portion and said second portion of said glowing fluid mixing in an aerosol mixing area during expulsion from said canisters.

17. The personal protection device of claim 14 further comprising a spring, hinged safety cap, said safety cap being maintained in a closed position by a locking member, said spring hinge opening said safety cap upon release of said locking member, wherein release of said safety cap permits depression of said trigger and activates said audio alarm means and said light.

18. A personal protection device, said personal protection device comprising:

a body section, said body section having a first end and a second end;

a canister receiving area within said body section, each of said canister receiving area having a first end and a second end, an aerosol canister containing an irritative substance, said canister having a nozzle extending through said first end of said canister receiving area and being proximate said first end of said body section and providing for expulsion of said canister contents into a transfer tube, said transfer tube directing the path of said contents, canister activation member, said canister activation member being in interactive contact with said canister, safety member, said safety member preventing said canister activation member from coming in contact with said canister, a trigger button, said trigger button being at said first end of said body section and being in contact with said safety member and said canister activation member, a light, said light being proximate said nozzle, a battery receiving area within said body section, audio alarm means, said audio alarm means being proximate said second end, electronic means, said electronic means being connected to said battery receiving area, said safety member, said audio alarm means and said light, wherein said safety member prevents said trigger button from contacting said canister activation means and deactivation of said safety member permits said trigger button to be depressed thereby contacting said canister activation member and activating said audio alarm means and said light.

19. The personal protection device of claim 18 further comprising gripping means between said first end and said second of said body, said gripping means being designed to receive and position a user's fingers.

20. The personal protection device of claim 18 wherein activation of said light and said audio alarm means is delayed from said trigger button contacting said canister activation means.

21. The personal protection device of claim 18 wherein said light and said audio alarm means, once activated, pulse in a predetermined pattern.

* * * * *